US005773101A

United States Patent [19]

Sanders

[11] Patent Number: 5,773,101

[45] Date of Patent: Jun. 30, 1998

[54] THREE DIMENSIONAL CAMOUFLAGE MATERIAL

[76] Inventor: Larry O. Sanders, 6582 S. Pontiac Ct., Englewood, Colo. 80111

[21] Appl. No.: 157,826

[22] Filed: Jan. 18, 1994

[51] Int. Cl.[6] ..... F41H 3/00

[52] U.S. Cl. ..... 428/17; 428/919

[58] Field of Search ..... 428/15, 17, 919

[56] References Cited

U.S. PATENT DOCUMENTS

| | | | |
|---|---|---|---|
| 4,106,124 | 8/1978 | Green | 2/422 |
| 4,323,605 | 4/1982 | Rush | 428/17 |
| 4,375,488 | 3/1983 | Hogan | 428/919 X |
| 4,493,863 | 1/1985 | Karlsson | 428/17 |
| 4,517,230 | 5/1985 | Crawford | 428/17 |
| 4,560,595 | 12/1985 | Johansson | 428/17 |
| 4,656,065 | 4/1987 | Yacovella | 428/919 X |
| 4,659,602 | 4/1987 | Birch | 428/88 |
| 4,767,649 | 8/1988 | Birch | 428/99 |
| 4,792,471 | 12/1988 | Lee | 428/17 |
| 4,837,056 | 6/1989 | Easley | 428/919 X |
| 4,868,019 | 9/1989 | Knickerbocker | 428/17 |

OTHER PUBLICATIONS

Photograph of Camouflage Material of Claimed Invention.

Brochure entitled "1995 Product Guide, The Ultimate 3–D Camouflage", Full Contact Nature Company.

Brochure entitled "Close Closer Full Contact", Full Contact Nature Company, Inc.

*Primary Examiner*—Henry F. Epstein
*Attorney, Agent, or Firm*—Sheridan Ross P.C.

[57] ABSTRACT

Disclosed is a camouflage material which includes a substantially continuous sheet and has a pattern which extends from the plane of the sheet. The present invention is a unique camouflage system suitable for all camouflage applications, including clothing, covers for blinds and tarps.

18 Claims, 5 Drawing Sheets

THREE DIMENSIONAL CAMOUFLAGE MATERIAL

FIELD OF THE INVENTION

The invention relates to camouflage material and in particular, camouflage material which is suitable for clothing, coverings for blinds and tarps.

BACKGROUND OF THE INVENTION

Generally, camouflage material is used to allow a person or an object to avoid detection by people, animals or machines. Various means of camouflaging people or objects are known in the wildlife hunting/observing, fishing and military fields. For example, hunters use camouflage techniques and materials which break up the outline or the surfaces of a person or object. The camouflage often functions by the use of varied colors and/or designs on the material to break up this outline or surface of the person or object.

The colors used on the camouflage material often are similar to the natural environment in which the material is used. Such camouflage material is particularly suitable for use in military applications. Additionally, there are circumstances where a person desires not to be seen by wildlife animals and, for safety purposes, to be seen by other people. Specifically, persons viewing or hunting wildlife animals desire to approach the wildlife animals without being detected. At the same time, these persons also desire to make themselves visible to other people nearby who may mistake them for a wildlife animal. Both of these objectives are possible because many animals only detect shapes and shades of grey, but detect colors poorly. For example, U.S. Pat. No. 4,868,019 to Knickerbocker discloses a camouflage system for visually concealing people and objects from animals wherein the selection of colors to be used depends on the extent of the animals color vision and the reflectivity of the colors used. All the images make use of more than one color to break up the image of the person wearing the camouflage article. Further, the designs depicted on the material vary and include abstract or random objects; or objects found in the environment wherein the camouflage material is used; or depict photographic images placed on the material.

Other known camouflage materials use three dimensional surfaces to break up the outline or the surface of the person or object sought to be camouflaged. For example, U.S. Pat. No. 4,517,230 to Crawford discloses an artificial leaf for camouflaging hunter's clothing and equipment by providing a three dimensional effect to destroy his silhouette and make him less visible and suspicious to game. Other camouflage materials have three dimensions where the material has partial cuts which rise from the plane of the material to create an added dimension. For example, U.S. Pat. No. 4,323,605 to Rush discloses camouflage material having V-shaped cuts to provide concealment for people and equipment from people or animals having a sense of color or geometric perception.

The problem of concealing persons or objects continues to challenge. To date, three dimensional camouflage clothing has proven inadequate for many applications because it fails to take into account a variety of environments in which the camouflage material is used. For example, wildlife observation and hunting take place in the animal's habitat during varied weather conditions. Thus, clothing often brushes or rubs against trees, branches, bushes and is worn in rain or snow. The prior art three dimensional camouflage material, such as the camouflage wraps or wherein cuts are made to break up the image, are likely to catch on trees, branches or bushes a wildlife observer or hunter may encounter.

Further, the prior art three dimensional camouflage material such as cuts and camouflage wraps fail to protect the object or person from the weather elements, such as rain or snow, which may be encountered and may even trap or retain rain or snow.

As a consequence, there is a need for camouflage material directed to overcoming these and other disadvantages of the prior art.

SUMMARY OF THE INVENTION

The camouflage material of the present invention comprises a substantially continuous sheet. The substantially continuous sheet has a pattern which extends from the plane of the sheet. The pattern can be formed by affixing a fold in the sheet which creates an affixed and unaffixed portion of the pattern.

In one embodiment, the pattern includes two substantially continuous lines. Further, the substantially continuous lines can have one or more branches extending from the substantially continuous lines. The intersection of continuous lines can be defined by an affixed portion of the first line intersecting an unaffixed portion of the second line. Alternatively, the intersection of the continuous lines can be defined by an unaffixed portion of the first line intersecting an unaffixed portion of the second line. In other embodiments, the pattern is a plurality of substantially continuous lines.

The camouflage material of the present invention can be used for clothing. The clothing articles may include shirts, pants, vests, jackets, coveralls, rain gear, gloves, mittens and headwear. Further, clothing articles can be water repellant. The camouflage material of the present invention may have artificial foliage elements attached to the pattern on the sheet. The artificial elements may include flowers, leaves, weeds, tree limbs, brush limbs and ferns.

The camouflage material of the present invention can comprise two or more different colors. The colors on the sheet can be different shades of blaze orange. The camouflage material of the present invention can comprise a sheet having a photographic image. The photographic image can be woods, trees, tree bark, branches, brush, plants, and grass.

BRIEF DESCRIPTION OF THE DRAWINGS

For a more complete understanding of the present invention and for further advantages thereof, reference is now made to the following Detailed Description taken in conjunction with the accompanying Drawings, in which.

DETAILED DESCRIPTION

Figure 1:
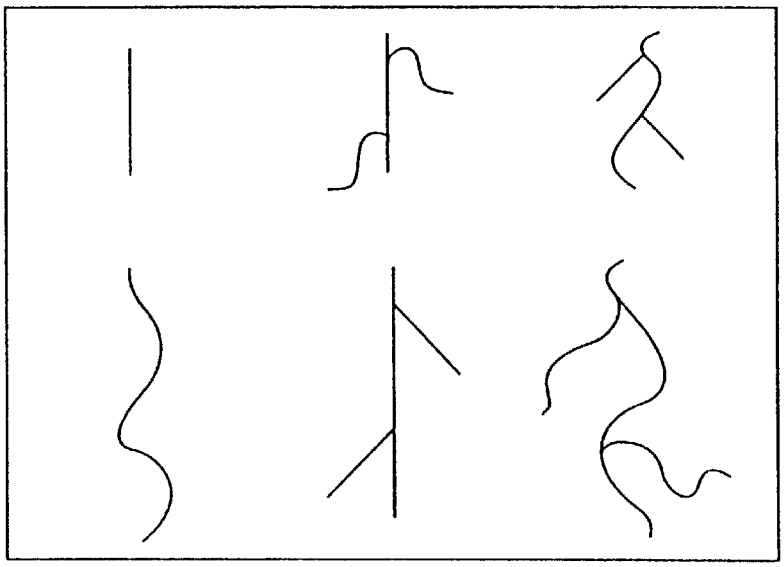
FIGS. 1 illustrates various examples of patterns comprising curved and straight lines and curved and straight lines comprising one or more curved or straight lines branching therefrom.

The present invention is directed toward a three dimensional camouflage material which comprises a substantially continuous sheet having a pattern on it wherein the pattern extends from the plane of the sheet. The camouflage material of the present invention has many uses including articles of clothing, coverings for blinds or other objects and tarps.

In accordance with one aspect of the present invention, the sheet is substantially continuous. Significant advantages are achieved by the sheet being substantially continuous. Often a user of camouflage material, such as a wearer of clothing made from it, brushes against various types of foliage when hunting, for example. If the camouflage material is not substantially continuous and thus, has significant openings, such openings are likely to catch on foliage and tear the camouflage material and/or cause undesirable noise which reveals the user. Further, openings in camouflage material allow moisture to readily penetrate the materials thereby requiring the user to make use of other means to provide moisture protection.

The sheet of the present invention, being substantially continuous, has substantial portions of the sheet which have no openings and thus have continuity. The remaining portions of the sheet can include the areas of openings such as the cuts or slits found in prior art camouflage material discussed above. The sheet of the present invention is considered to be a substantially continuous sheet if the portion of the sheet having no openings comprises at least about 50% of the surface area of the sheet, more preferably, at least about 90% of the surface area of the sheet, and even more preferably, at least about 95% of the surface area of the sheet.

It should be noted that many products made from the camouflage material of the present invention can include portions of the product in which the material is discontinuous. For example, clothing articles made from the camouflage material often comprise button holes or snaps to affix the clothing article to the wearer or various pockets and loops to contain items needed by the wearer of the clothing article. Such material and products are considered to be substantially continuous and thus, within the scope of the present invention. Further, the sheet of the present invention is considered to be substantially continuous regardless of whether the sheet is one piece of material or numerous pieces of material attached together with substantially no openings. For example, clothing articles made from the camouflage material of the present invention can comprise several pieces of material attached together by, for example, sewn seams. Such articles are considered to be substantially continuous and thus, within the scope of the present invention.

The sheet can be any of numerous materials. Preferably, the material selected for the sheet is adaptable for use as clothing and has resiliency against moisture and tearing. A non-exhaustive list of materials suitable for the sheet include natural products, such as cotton and wool, synthetic resins, water repellant materials, such as GORE-TEX®[1] or rubberized material, or combinations thereof.

[1] GORE-TEX® is a registered trademark of W. L Gore & Associates, Inc.

Another important aspect of the present invention is that the camouflage material is three dimensional. As discussed above, it is desirable that the material be capable of breaking up the outline or surface of the person wearing, or the object covered by, the camouflage material. The camouflage material of the present invention breaks up the outline or surface, at least in part, by a three dimensional effect created by a pattern on the sheet extending from the plane of the sheet. As will be discussed in more detail below, there are a variety of ways for a portion of the sheet to extend from the plane of the sheet.

In this manner, the camouflage material of the present invention creates a significant camouflage effect because the added dimension provides depth of field and texture to the camouflage material. Further, the added dimension can create shadows on the material by natural light hitting the portion of sheet which extends from the plane of the sheet. The shadow effect causes various color shades which serve to further break up the continuity or visual image of the outline or body surface of the user or object.

A further aspect of the present invention is that the portion of the sheet which extends from the plane of the sheet forms a pattern. The pattern can be any visual image which serves to break up the outline or surface of the person wearing, or the object covered by, the material. For example, one pattern is a substantially continuous line defined by the raised area of sheet which is substantially continuous between two points on the sheet.

In this manner, the pattern formed by the raised area can take many forms. The pattern formed may comprise one or more curved and/or straight lines. The pattern formed may also comprise one or more curved and/or straight lines, branching from other curved and/or straight lines. FIG. 1 illustrates various examples of curved and straight lines and curved and straight lines further comprising one or more curved and straight lines branching therefrom.

The pattern formed may also comprise any geometric shape. For example, the pattern formed may comprise one or more circles, triangles, ovals and the like in various combinations. Further, the pattern formed may comprise one or more abstract images or contorted geometric shapes.

Figure 2:
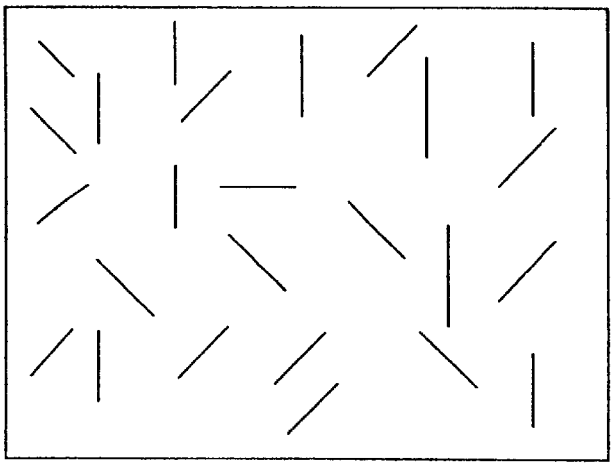
FIG. 2 illustrates a preferred pattern to be used in the wildlife animal's habitat or environment.
Figure 3:
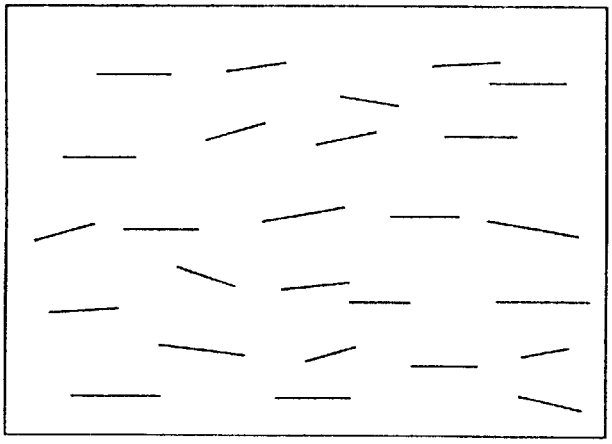
FIG. 3 illustrates a preferred pattern to be used in the wildlife animal's habitat or environment.

Further, the pattern formed may comprise images which simulate images naturally found in wildlife animal's habitat or environment, such as trees, bushes or grasses. For example, as shown in FIG. 2, the pattern would mimic or represent various motifs in the habitat or environment, e.g. deciduous growth, by straight continuous lines oriented in a substantially vertical manner. Preferably, more than 50% of the straight continuous lines are oriented between 45 degrees and 135 degrees on a 0 to 180 degree horizontal reference. More preferably, more than 75% of the short straight continuous lines are oriented between 45 degrees and 135 degrees. Another example is shown in FIG. 3, where a pattern comprises continuous lines oriented in a substantially horizontal manner. Preferably, more than 50% of the short straight continuous lines are oriented between 0 to 45 degrees and 135 to 180 degrees on a 0 to 180 degree horizontal reference. More preferably, more than 75% of the short straight continuous lines are oriented between 0 to 45 degrees and 135 to 180 degrees.

Further, the pattern formed may comprise one or more of various images described above at varying densities.

Figure 4:
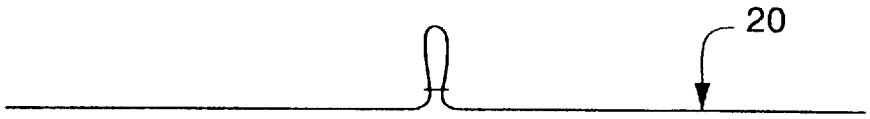
FIG. 4 is a cross section of a preferred pattern.

In accordance with another aspect of the present invention, the pattern discussed above extends from the plane of the sheet. With reference to FIG. 4, a cross section of a preferred pattern, later described, on the sheet is shown. The plane of the sheet 20 refers to the primary surface of the camouflage material. For example, in a garment or cover such as shown in FIG. 9, the plane of the sheet 20 is the exterior surface of the garment as it hangs or is draped over the body.

The term "extends" refers to the pattern being sufficiently raised from the plane of the sheet to make visible shadows caused by the pattern at various times of daylight. The length of extension takes into account various factors associated with the environment in which the material is used including the type and density of foliage likely to be encountered by the user as well as the weather conditions, including the amount of sunlight. The pattern preferably extends from the plane of the sheet by at least a 1/16", more preferably by at least about an 1/8" and even more preferably by at least about a 1/4".

Figure 5A:
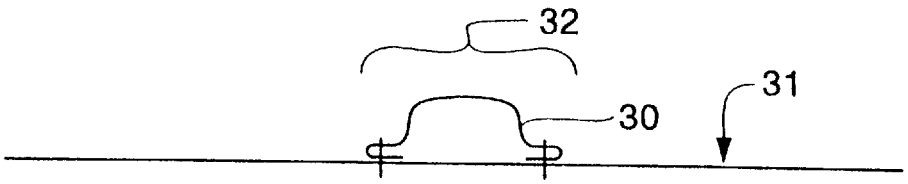
FIGS. 5A and 5B are a cross section of various ways to extend a pattern from the plane of the sheet.
Figure 5B:
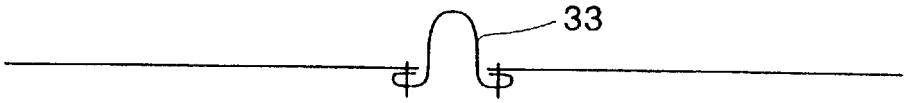

The pattern on the material extending from the sheet can be formed in a variety of ways. In general, the extension of the pattern from the plane of the sheet is formed by affixing portions of the sheet or pieces of material on the sheet. Affixing can be accomplished in any suitable manner, including stapling, sewing and gluing. For example, as shown in FIG. 5A, the cross section of one embodiment of the pattern shows that the pattern can be formed by affixing a separate, detached piece 30 of material at the plane 31 of the sheet to cause a raised area 32. Further, as shown in FIG. 5B, the pattern can be formed by a separate, detached piece 33 of the sheet positioned in an opening in the plane of the sheet and affixing the separate and detached piece of the sheet with the plane of the sheet at the opening. As discussed above, the substantially continuous nature of the sheet is not affected by separate, detached pieces of sheet being affixed to other portions of the sheet and thus, such embodiments are within the scope of the present invention.

In a preferred embodiment, the pattern is formed by gathering a portion of the sheet from the plane of the sheet to cause a portion of the sheet, formerly part of the plane of the sheet, to extend from the plane of the sheet as a fold. For example, in FIGS. 6A–6D a straight continuous line pattern 40 is formed by gathering a portion of the sheet so that a fold 41 in sheet is formed and affixing a folded portion of the sheet along a line at the plane 42 of the sheet. The fold in the sheet causes overlapping portions of the sheet defined by either side of the fold.

Figure 6A:
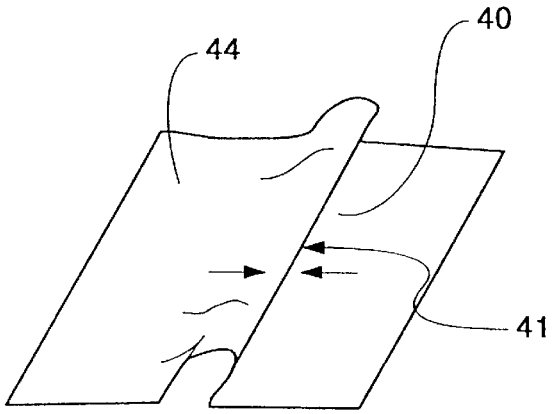
FIGS. 6A–6D are a perspective view and a cross sectional view of one preferred way to form a pattern.
Figure 6B:
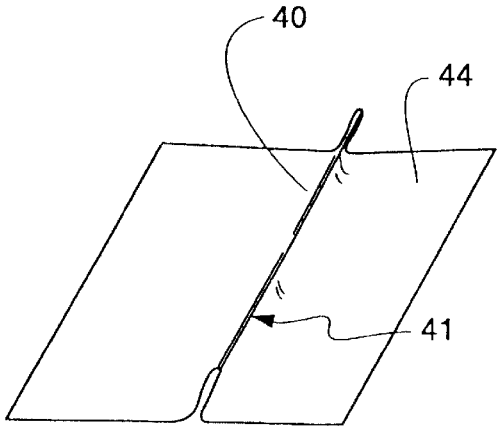
Figure 6C:
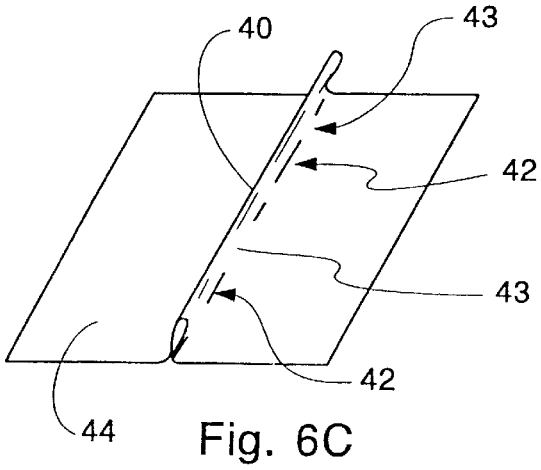
Figure 6D:
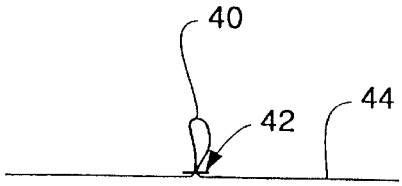

Preferably, the overlapping portions of the sheet caused by the fold in the sheet are affixed at various points along the continuous line as shown in FIG. 6C. Thus, a line of a pattern can have an affixed portion 42 and an unaffixed portion 43 with the unaffixed portion 43 being folded and raised from the general plane 44 of the material by virtue of an adjacent folded affixed portion 42. More preferably, as shown by FIG. 6C and the cross-section view of an affixed portion of the fold in FIG. 6D, the overlapping portions of the sheet caused by the fold 41 in the sheet are affixed at various points where the fold 41 immediately begins to extend from the plane of sheet 44.

Figure 7:
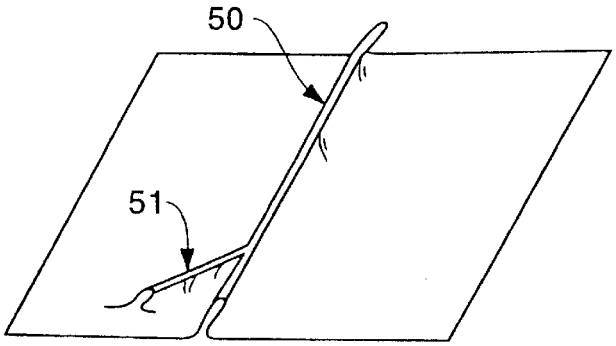
FIG. 7 is a perspective view of a pattern comprising a straight continuous line and further comprising a second continuous line branching or intersecting said first continuous line.
Figure 8:
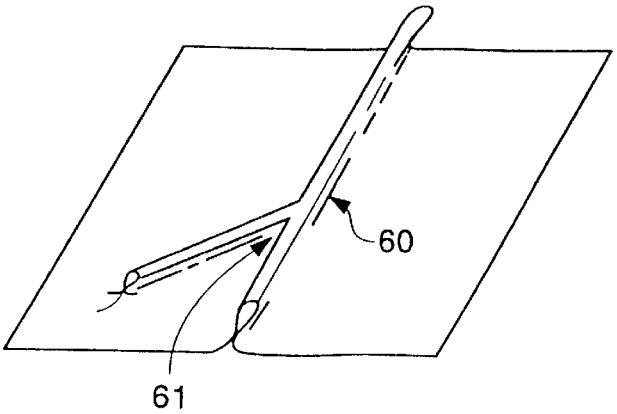
FIG. 8 is a perspective view isolating the affixed and unaffixed portions of the pattern.

Referencing FIG. 7, a pattern of the present invention can include a straight continuous line 50 and further comprise a second straight continuous line 51 branching from or intersecting the first continuous line. The first continuous line 50 is formed as generally described above with reference to FIG. 6. Preferably, the second continuous line 51 is formed by gathering a portion of the sheet so that a fold in this sheet is formed and the overlapping portions of the sheet are affixed at various points. Preferably, an unaffixed portion of the second continuous line intersects either an affixed or unaffixed portion of the first continuous line. More preferably, as illustrated in FIG. 8, the intersection of the two continuous lines is defined by one of the folds being affixed 60 and the other fold being unaffixed 61 at the intersection. The result is a less rigid area at the intersection of the continuous lines which is sufficiently flexible to allow the tree and brush branches to slide on the sheet without catching, tearing or creating undesirable rustling. If, on the other hand, the first and second continuous lines intersect at affixed portions, the intersection of the respective folds is a stiff and substantially rigid area. Such areas are not preferred because they are susceptible to catching tree and bush branches and/or collecting moisture such as rain or snow.

Figure 9A:
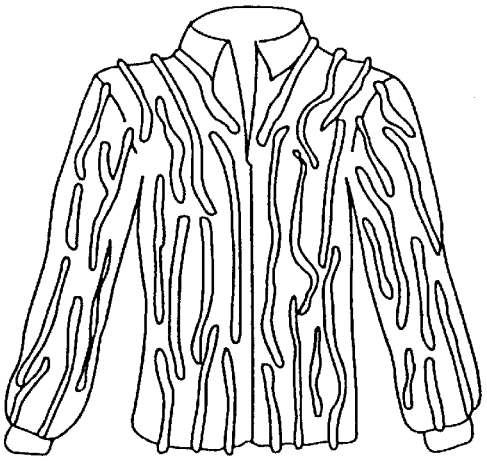
FIGS. 9A and 9B illustrate a garment having a pattern.
Figure 9B:
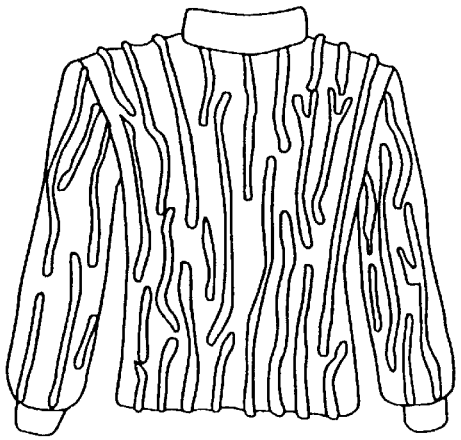

The camouflage material of the present invention may be used for garments and articles of clothing such as shirts, pants, vests, jackets, coveralls, rain gear, gloves, mittens or headwear. FIGS. 9A and 9B respectively show the front and back of a jacket having a pattern comprising a plurality of continuous lines which are align substantially vertically with the wearer of the garment and which are substantially parallel to each other. Additionally, any of the other patterns as broadly described herein are suitable as well. Further, the camouflage material of the present invention may be used for covers for blinds used by hunters or covers over objects. In addition, the camouflage of the present invention can be used in a variety of military applications. In its various applications, the camouflage material of the present invention may have a pattern which runs up against a border of, for example, a garment. Preferably, a continuous line of a pattern is not affixed at the intersection of the continuous line and the border of a garment.

Figure 10:
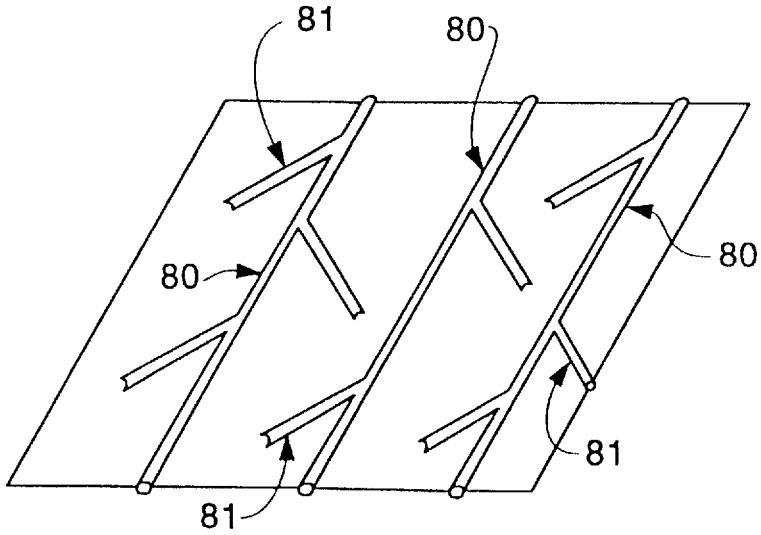
FIG. 10 illustrates a pattern having multiple substantially continuous vertical lines further comprising a plurality if second continuous lines branching from the substantially vertical continuous lines.
Figure 11:
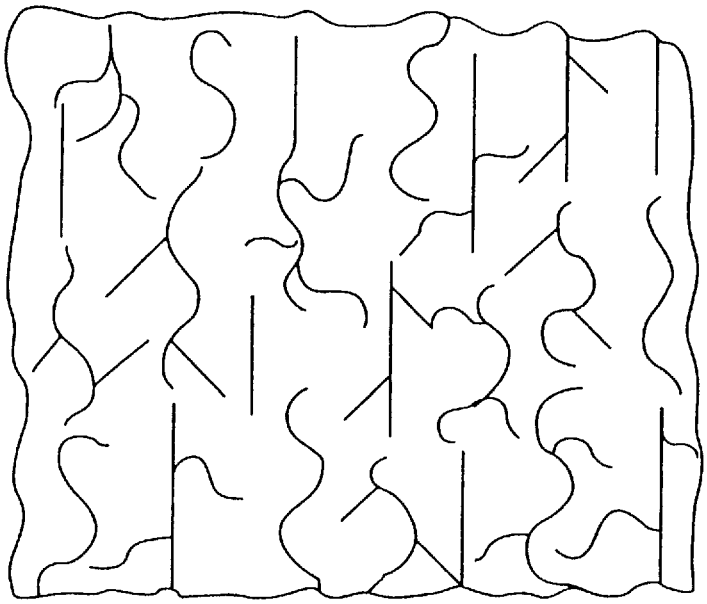
FIG. 11 illustrates a pattern comprising multiple continuous lines, with and without branches, randomly distributed.

With reference to FIG. 10, a further embodiment is a pattern having multiple substantially continuous vertical lines 80 with a plurality of second continuous lines 81 branching from or intersecting the substantially vertical continuous lines 80. It is a further embodiment that at least a portion of the plurality of second continuous lines 81 are angled from the substantially vertical continuous lines 80 at about the same angle. In a still further embodiment, the pattern comprises multiple, randomly angled lines. As shown by FIG. 9, it is still a further embodiment that the pattern comprises multiple continuous lines, with and without branches, randomly distributed.

Any of the embodiments of the camouflage material described herein can also further have a means where articles may be attached to the camouflage material. The articles can be anything which will assist in further breaking the outline of the object or person. Such articles can be artificial foliage elements or geometric shapes such as circles, rectangles or other multi-sided figures. Examples of foliage elements include flowers, leaves, weeds, tree limbs, brush limbs and ferns.

The camouflage material of the present invention can be any color. For example, the material may comprise one or more colors found in the environment in which the material is used, such as brown, green or beige. In this manner, the material will provide additional camouflage effect. Also, the material can include bright colors, such as blaze orange or neon colors. The use of two or more colors further breaks up the outline of the wearer of the garment making use of the camouflage material in addition to the three dimensional pattern. In a further embodiment, the portions of the material which form the pattern are a different color than the plane of the sheet.

A further embodiment of the invention is to use camouflage material as broadly described above, wherein the material is a bright color, such as blaze orange. Such an embodiment is particularly useful for applications involving the hunting or observing of wildlife because most animals cannot detect such bright colors but rather only perceive various shades of gray. Thus, the use of bright colors allows for the user of the camouflage to be more readily detected by other humans while still being effective camouflage for animals due to the three dimensional patterns. In a variation of this embodiment multiple bright colors or shades of bright colors are used. Thus, a further camouflage effect is obtained due to the pattern created by use of multiple colors. For example, multiple shades of blaze orange can be used. In this manner, compliance with many states' hunting regulations can be achieved while having significant camouflage effect. Some states require certain amounts of continuous blaze orange on hunters during some hunting seasons.

A further embodiment is that the sheet used in any of the embodiments described herein include photographic images which have been transferred to the sheet. The photographic image can consist of various images in nature. Such images can include woods, tree bark, branches, brush, plants and grass. A still further embodiment is that the portions of the sheet which form the raised pattern substantially coincide with the photographic image found on the sheet. In this embodiment, for example, a continuous vertical line could represent the tree trunk and other continuous lines intersecting the continuous vertical line would represent the tree branches.

While various embodiments of the present invention have been described in detail, it is apparent that modifications and adaptations of those embodiments will occur to those skilled in the art. It is to be expressly understood, however, that such modifications and adaptations are within the scope of the present invention, as set forth in the following claims:

What is claimed is:

1. A three dimensional camouflage material, comprising a substantially continuous sheet having a pattern, wherein said pattern extends from the plane of said sheet and wherein said pattern is substantially integral with said sheet and wherein said pattern is formed by permanent affixation of multiple folds in said sheet to create affixed portions of said pattern and unaffixed portions of said pattern.

2. A three dimensional camouflage material, as claimed in claim 1, wherein said pattern comprises first and second substantially continuous lines.

3. A three dimensional camouflage material, as claimed in claim 2, wherein an affixed portion of said first line intersects an unaffixed portion of said second line.

4. A three dimensional camouflage material, as claimed in claim 2, wherein an unaffixed portion of said first line intersects an unaffixed portion of said second line.

5. An article of clothing comprising the three dimensional camouflage material of claim 1.

6. An article of clothing, as claimed in claim 5, wherein said article of clothing is selected from the group consisting of shirts, pants, vests, jackets, coveralls, rain gear, gloves, mittens and headwear.

7. An article of clothing, as claimed in claim 6, wherein at least a portion of said sheet is blaze orange.

8. An article of clothing, as claimed in claim 6, wherein said sheet is water repellent.

9. An article of clothing, as claimed in claim 5, wherein said pattern comprises a plurality of substantially vertical lines and said pattern further comprises a plurality of branches from each of said substantially vertical lines.

10. An article of clothing, as claimed in claim 9, wherein all of said branches are angled with respect to said substantially vertical lines at about the same angle.

11. An article of clothing, as claimed in claim 5, wherein said pattern consists essentially of substantially vertical lines.

12. A three dimensional camouflage material, as claimed in claim 1, wherein said material comprises artificial foliage elements attached to said sheet on said pattern.

13. A three dimensional camouflage material, as claimed in claim 12, wherein said artificial foliage elements are selected from the group consisting of flowers, leaves, weeds, tree limbs, brush limbs and ferns.

14. A three dimensional camouflage material, comprising a substantially continuous sheet having a pattern, wherein said pattern extends from the plane of said sheet, wherein said pattern is substantially integral with said sheet, wherein said pattern is formed by permanent affixation of multiple folds in said sheet and wherein said sheet comprises at least two different colors.

15. A three dimensional camouflage material as claimed in claim 14, wherein at least one of said colors on said sheet is blaze orange.

16. A three dimensional camouflage material, as claimed in claim 15, wherein the color of said folds in said pattern is different from the color of the plane of said sheet.

17. A three dimensional camouflage material, comprising a substantially continuous sheet having a pattern, wherein said pattern extends from the plane of said sheet and wherein said pattern is formed by permanent affixation of multiple folds in said sheet.

18. A three dimensional camouflage material, comprising a substantially continuous sheet having a pattern, wherein said pattern extends from the plane of said sheet, wherein said pattern is substantially integral with said sheet, wherein said pattern is formed by permanent affixation of multiple folds in said sheet and wherein said sheet comprises two or more shades of orange.

* * * * *